US009745183B2

(12) United States Patent
Jakob

(10) Patent No.: US 9,745,183 B2
(45) Date of Patent: Aug. 29, 2017

(54) CLOSING MACHINE

(75) Inventor: Timo Jakob, Framersheim (DE)

(73) Assignee: KHS GmbH, Dortmund (DE)

( * ) Notice: Subject to any disclaimer, the term of this patent is extended or adjusted under 35 U.S.C. 154(b) by 1687 days.

(21) Appl. No.: 12/994,387

(22) PCT Filed: May 27, 2009

(86) PCT No.: PCT/EP2009/003755
§ 371 (c)(1),
(2), (4) Date: Nov. 23, 2010

(87) PCT Pub. No.: WO2009/146823
PCT Pub. Date: Dec. 10, 2009

(65) Prior Publication Data

US 2011/0072762 A1 Mar. 31, 2011

(30) Foreign Application Priority Data

Jun. 4, 2008 (DE) ..... 10 2008 026 632

(51) Int. Cl.
*B65B 51/10* (2006.01)
*B67C 7/00* (2006.01)
(Continued)

(52) U.S. Cl.
CPC ..... *B67C 7/0086* (2013.01); *B67B 3/02* (2013.01); *B67B 3/2033* (2013.01); *B67B 2201/08* (2013.01); *B67C 2003/228* (2013.01)

(58) Field of Classification Search
CPC .. B65B 7/2878; B65B 7/72842; B65B 7/2835
(Continued)

(56) References Cited

U.S. PATENT DOCUMENTS 2,976,898 A * 3/1961 Coady et al. ..... 141/346
3,393,491 A * 7/1968 Burton ..... A61L 2/07 137/614.17
(Continued)

FOREIGN PATENT DOCUMENTS

DE 4304220 8/1994
DE 4313325 11/1994
(Continued)

*Primary Examiner* — Hemant M Desai
*Assistant Examiner* — Eyamindae Jallow
(74) *Attorney, Agent, or Firm* — Occhiuti & Rohlicek LLP

(57) ABSTRACT

Closing machine for closing bottles or similar containers (2) using closures (3, 3*a*), having a plurality of closing stations (11) which each have a closing tool (12, 14) and a container carrier and are formed on the circumference of a rotor (4), which can be driven in circulation around a vertical machine axis (MA), wherein the rotor (4) has formed on it, in the region of the closing stations (11), a sterile chamber (5) which is bounded in the direction of the surroundings by walls or wall portions (6, 7, 8, 9) and into which the containers (2), which are retained in a hanging state on the container carriers, extend by way of their container mouth (2.1) which is to be closed, and wherein the respective closing tool (12, 14) extends into the sterile chamber (5) merely by way of a part which interacts with the container (2) which is to be closed and/or with the closure (3, 3*a*), all the rest of its functional elements being arranged outside the sterile chamber (5).

12 Claims, 2 Drawing Sheets

(51) Int. Cl.

| | |
|---|---|
| ***B67B 3/02*** | (2006.01) |
| ***B67B 3/20*** | (2006.01) |
| *B67C 3/22* | (2006.01) |

(58) Field of Classification Search
USPC ..... 53/329.2, 329.3, 329.4, 167, 300, 317, 53/331.5
See application file for complete search history.

(56) References Cited

U.S. PATENT DOCUMENTS

| | | | | | |
|---|---|---|---|---|---|
| 3,690,088 | A * | 9/1972 | Anderson et al. | 53/452 | |
| 3,706,176 | A * | 12/1972 | Leatherman | 53/488 | |
| 4,237,360 | A * | 12/1980 | Pohlenz | 219/604 | |
| 4,648,421 | A * | 3/1987 | Chant | B65B 39/004 | 137/312 |
| 4,729,204 | A * | 3/1988 | Weiss | 53/88 | |
| 5,016,690 | A * | 5/1991 | Ljung-crantz | G01F 11/024 | 141/183 |
| 5,487,253 | A | 1/1996 | Hieltscher et al. | | |
| 5,653,091 | A * | 8/1997 | Stark | B65B 55/04 | 53/167 |
| 5,848,515 | A * | 12/1998 | Catelli et al. | 53/167 | |
| 6,082,418 | A | 7/2000 | Naecker | | |
| 6,230,472 | B1 | 5/2001 | Stahlecker | | |
| 6,305,438 | B1 * | 10/2001 | Sjoholm | B65B 3/26 | 141/114 |
| 7,121,062 | B2 * | 10/2006 | Till | 53/167 | |
| 2003/0034086 | A1 * | 2/2003 | Stewart | B65B 3/003 | 141/181 |
| 2004/0261262 | A1 * | 12/2004 | Clemons et al. | 29/832 | |
| 2008/0078144 | A1 * | 4/2008 | Cirio | B67B 3/2033 | 53/359 |

FOREIGN PATENT DOCUMENTS

| | | |
|---|---|---|
| DE | 19806520 | 8/1999 |
| DE | 202006019465 | 3/2007 |
| EP | 1 262 445 | 12/2002 |
| EP | 1 514 835 | 3/2005 |
| EP | 1 468 959 | 9/2007 |
| GB | 2174682 | 11/1986 |

* cited by examiner

CLOSING MACHINE

CROSS-REFERENCE TO RELATED APPLICATIONS

This application is the National Stage of International Application No. PCT/EP2009/003755, filed on May 27, 2009, which claims the benefit of German Application Serial No. 10 2008 026 632.9, filed on Jun. 4, 2008, the contents of both of the foregoing applications are hereby incorporated by reference in their entirety.

FIELD OF DISCLOSURE

The invention relates to a closing machine for closing containers with closures.

BACKGROUND

Units are known for the sterile, and in particular for the aseptic cold filling of bottles or similar containers with a liquid product, for example with a liquid product that spoils easily, for example milk products, and also for the subsequent, again sterile or aseptic cold, closing of the containers. The bottles or containers are, in that case, transported in a sterile chamber during supply to the filling machine, during filling, during transport from the filling machine to a downstream closing machine and during closing. When the unit is running, i.e. on filling and closing, the chamber is flushed with or exposed to a sterile gas and/or vapor-forming medium and from time to time, i.e. within predetermined cleaning and disinfecting cycles or intervals, it is treated with a cleaning and/or disinfection and/or sterilization medium.

Known units suffer from the particular disadvantage that, with the closing machine in question, all of the equipment of that machine and, in particular, the closing tools provided at the closing positions, are arranged in the sterile chamber. This means that the construction of those closing tools, at least at their outer surfaces and/or regions, must also be produced from a material that is resistant to corrosion by the cleaning and disinfection means, for example from stainless steel. Furthermore, the outer surfaces of the closing tools have functionally necessary recesses, slits, indentations, etc. that germs like to colonize. As a result, it has been necessary to use large amounts of cleaning and disinfection materials to clean and disinfect the sterile chamber in the closing machine zone.

SUMMARY

The aim of the invention is to provide a closing machine that is particularly suitable for use in a unit for sterile and thus in particular also for aseptic cold filling of products into bottles or the like as well as for closing such containers in a sterile manner, and that avoids the disadvantages mentioned above, i.e. reduces the risk of contamination, and considerably reduces the means or chemicals required for cleaning, sterilization, and/or for disinfection of the sterile chamber.

A closing machine as described herein solves this problem.

Further embodiments, advantages and applications of the invention will become apparent from the following description of embodiments and from the figures. To this end, all described and/or depicted features, alone or in any combination, constitute the subject matter of the invention, independently of their synopsis in the claims or their dependencies. Further, the contents of the claims form part of the description.

BRIEF DESCRIPTION OF THE FIGURES

The invention will now be described in more detail with the aid of FIGS. 1 and 2, which each show, in simplified form and in partial section, a rotary type closing machine in the region of a sterile chamber.

DETAILED DESCRIPTION

Figure 1:
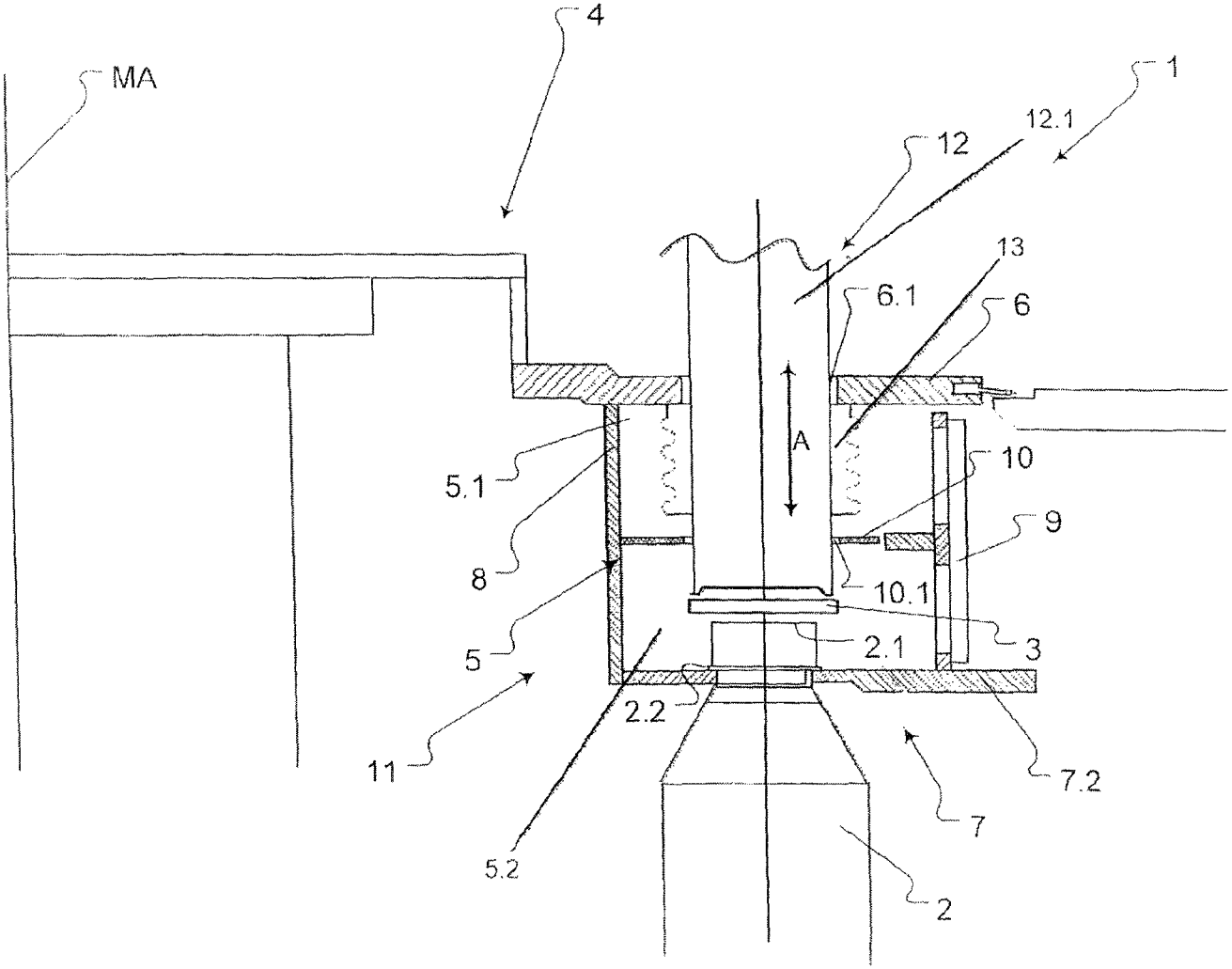

The closing machine 1 shown in FIG. 1 acts in the embodiment shown in this figure to seal bottles 2, for example plastic bottles, with closures 3, for example in the form of foils, that can be fastened to the bottles or to the bottle mouth 2.1 thereof by welding or sealing, i.e. by the use of heat.

The closing machine 1 includes a rotor 4 that can be driven about a vertical machine axis MA with, on its circumference, an annular channel-like sterile chamber 5 concentrically surrounding the machine axis MA. The sterile chamber 5 is delimited from the surroundings by a plurality of wall sections.

In the embodiment shown, the wall sections are an upper wall section 6, a lower wall section 7, a radially inner annular wall section 8 and outer wall sections 9. An intermediate wall 10 between the wall sections 6 and 7 divides the chamber 5 into an upper chamber part 5.1 and a lower chamber part 5.2. In the embodiment shown, the upper wall section 6, the inner annular wall section 8, the intermediate wall 10 and the part section 7.1 of the lower wall section 7 are mounted on the rotor 4 and thus revolve with it. The outer wall sections 9, as well as the part section 7.2 of the wall section 7, do not revolve with the rotor 4. Instead, they are attached to a machine frame of the closing machine 1.

In order to close bottles 2 with closures 3, a plurality of closing stations 11 are formed on the circumference of the rotor 4, one of which is shown in FIG. 1. These closing stations 11 are distributed at regular angular intervals about the axis MA.

Each closing station 11 includes a closing tool in the form of an induction welding head 12, of which in FIG. 1 only the inductively heated induction seal 12.1, which extends into the chamber 5 or into both upper and lower chamber parts 5.1 and 5.2, is shown. This is guided through an opening 6.1 in the upper wall section 6 and can move as shown by the double headed arrow A along its seal axis or along a vertical axis parallel to the machine axis MA between an upper start position and a lowered operational position. In the lowered operational position, the lower seal surface of the induction seal 12.1 is applied and pressed against the corresponding closure 3 against the mouth opening 2.1 of the bottle 2 to be closed at the closing station 11 so that the closure 3 and the corresponding bottle 2 can be joined by sealing or welding.

The area through which the induction seal 12.1 passes through the wall section 6 is sealed off with a suitable material, for example consisting of a bellows-like gasket 13 formed from PTFE (polytetrafluoroethylene).

The induction seal 12.1 extends through an opening 10.1 in the intermediate wall 10 with its lower end in the lower chamber part 5.2. The outer surface of the induction seal 12.1 is made from a material that is as smooth as possible. The induction seal 12.1 is formed from a suitable, good heat conductive but corrosion-resistant material to enable it to function as a passive, heat-conductive component. An example of such a material is stainless steel.

All of the other functional elements of the induction welding head 12, such as the elements for lifting, lowering, and heating the induction seal 12.1, are above the wall section 6 and outside the sterile chamber 5.

Each closing station 11 is provided with a container carrier that is formed by an opening in the part section 7.1 below the induction seal 12.1. The bottle 2 is hung from this container carrier by a mouth flange 2.2 below the bottle's mouth 2.1 so that only the mouth region above the mouth flange 2.2 reaches into the chamber 5, and in particular into the lower chamber part 5.2.

During operation of the closing machine, i.e. for aseptic closing of the bottles 2, the chamber 5 is exposed to or flushed with an appropriate gas and/or vapor-forming medium that ensures the sterility of the chamber 5. A suitable medium is sterile air. This medium is fed into the sterile chamber 5 through lower chamber part 5.2 and leaves the sterile chamber 5 at least in part via the upper chamber part 5.1.

For closing, the bottles 2 are individually transferred to an operational position of the closing stations 11 so that there they hang and are retained by their mouth flange 2.2 with the bottle mouth 2.1 in the lower chamber part 5.2 for closing with the closures 3. The sealed bottles are removed from the closing stations 11 on a container-discharge means.

The particular advantage of the closing machine 1 or the closing stations 11 lies in that only smooth regions of the induction seal 12.1, with no recesses, undercuts or the like that could allow germs to colonize, are arranged in the sterile chamber 5. This enables the whole chamber 5 to be kept germ-free at a considerably reduced cost. This also increases the time interval between cleaning and/or sterilization cycles, shortens the cycle time, and reduces the quantity of cleaning and/or sterilization media consumed.

Figure 2:
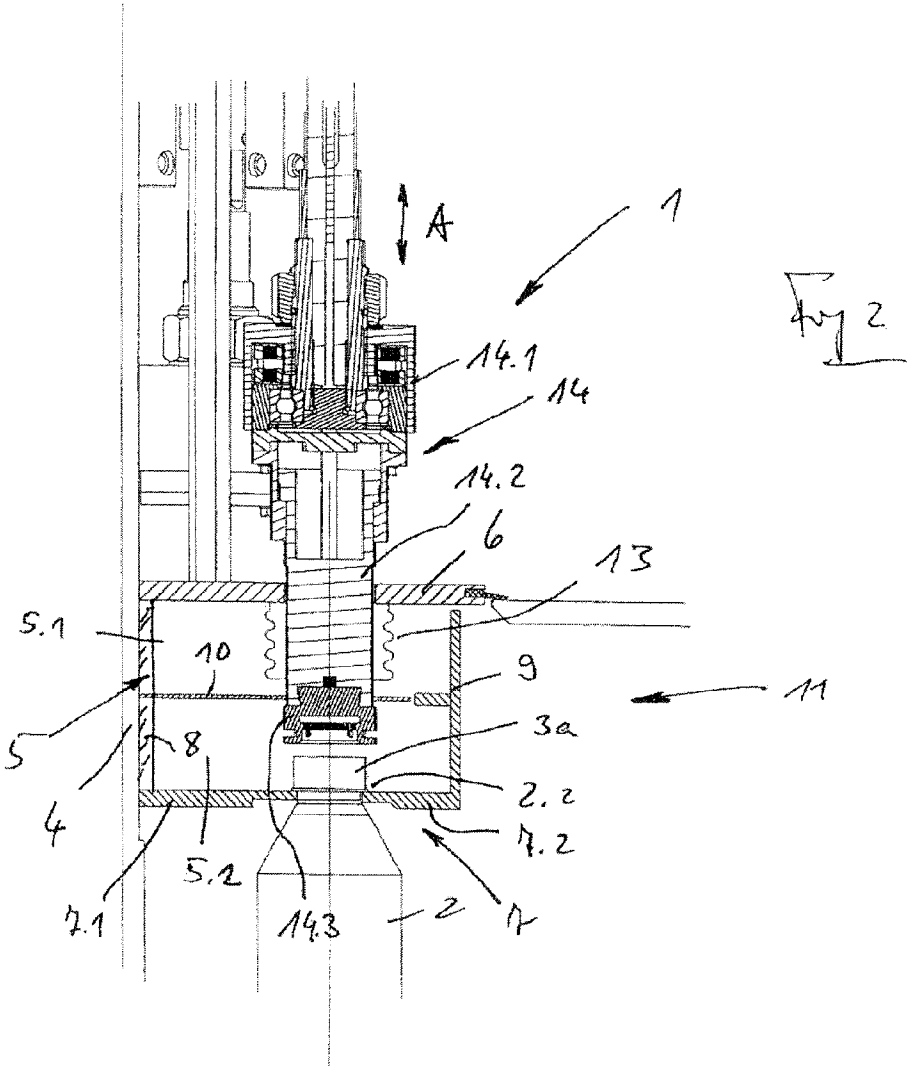

FIG. 2 shows the closing machine 1 for closing the bottles 2 with cap-like twist or screw closures 13. To this end, the individual closing stations 11 are each provided with a screw capper 14 having a construction that is known to the skilled person. The screw capper 14 includes a drive 14.1, a longitudinal and closed capper head 14.2 having a spindle or shaft, and a capping cone or capping element 14.3 provided at the lower end of the capper head 14.2 and connected with the spindle. In the embodiment shown in FIG. 2, only the part of the length of the screw capper head 14.2 having a smooth cylindrically shaped outer surface on each screw capper 14 extends through the wall section 6 into the sterile chamber 5 and thus also through the intermediate wall 10 into the lower chamber part 5.2 so that the capping element 14.3 that cooperates with the twist or screw closures 3*a* is arranged in this lower chamber part 5.2.

The passage of the capping head 14.2 through the wall section 6 is again sealed using the bellows gasket 13. When capping the bottles 2 with the twist or screw closures 3*a*, the screw cappers 14 can be moved up and down in a vertical direction (arrow A) and the closing elements 14.3 provided on the capping head 14.2 are driven in rotation.

Like the embodiment shown in FIG. 1, the embodiment shown in FIG. 2 has the advantage of allowing entry into the sterile chamber 5 of only those functional elements of the screw capper 14 that have a smooth and easily cleaned and sterilized outer surface. These are arranged within the lower chamber part 5.2. Other functional elements, which are harder to clean and sterilize, are completely outside the chamber 5. These functional elements would include the drive 14.1 and the functional elements that lift and lower the screw capper 14, In one example, the closing machine 1 is a component of a unit for sterile, for example aseptic cold, filling of a liquid product into the bottles 2 or into other containers as well as to seal the bottles 2 with the closures 3 or 3*a*. Prior to filling, during filling and sealing, and also over the whole transport path between the filling machine and the closing machine, the bottles 2 are always moved with at least their mouth region 2.1 in a sterile chamber.

The closing machine 1 is suitable not only for closing bottles 2, but also for closing other containers.

The invention has been described using exemplary embodiments. Modifications and deviations are possible without departing from the inventive concept underlying the invention.

Thus, for example, other types of closing tools may be used in the same or similar manner on the closing machine 1 or at its closing stations 11. Examples of such closing tools include tools for fastening cap-like closures to bottles by application and permanent mechanical deformation of the closures. When using such closing tools only functional elements that cooperate directly with the closures are arranged inside the chamber 5 or the upper and lower chamber parts 5.1 and 5.2. Other functional elements, such as functional elements that are hard to clean and/or sterilize, remain outside the sterile chamber 5. These include, for example drives and/or lifting devices for lifting and lowering the respective closing tools.

Furthermore, it is also possible, instead of using an induction welding head 12 to weld or seal the closures 3 with the opening rim 2.1 of the bottles 2, to use a closing tool employing another manner of fixing or welding the respective closure 3 with the bottle 2, for example by ultrasound energy and/or using microwave energy.

It was mentioned above that instead of the induction welding head 12 and screw capper 14, other closing tools could be used. The inventive construction of the closing machine, however, is of particular advantage when using such closing tools wherein the part of the closing tool that extends into the chamber 5 is a purely passive component that has a shaped part with a corrosion-resistant, smooth surface that is free of undercuts, indentations, joints, recesses etc., and that can be cleaned and sterilized without problems. A passive component in this context is the induction seal 12.1 and also, for example with a closing tool operating with ultrasound, a seal type tool that transfers ultrasound energy to the closure 3 and the bottle opening or mouth 2.1.

LIST OF REFERENCE NUMERALS

1 closing machine
2 bottle
2.1 bottle mouth
2.2 mouth flange
3, 3*a* closure
4 rotor
5 sterile chamber
5.1, 5.2 upper and lower chamber parts
6, 7, 8, 9 wall section
7.1, 7.2 part section of wall section 7
10 intermediate wall
10.1 opening
11 closing station
12 induction welding head

12.1 induction seal
13 bellows seal
14 screw capper
14.1 drive
14.2 cylindrical capper head
14.3 capping cone or capping element
A lifting motion of closing tool
MA vertical machine axis Having described the invention, and a preferred embodiment thereof, what is claimed as new and secured by Letters Patent is:

1. An apparatus for closing containers with closures, said apparatus comprising a closing machine, said closing machine comprising a rotor that can be rotated about a vertical machine axis, a container carrier formed on the circumference of said rotor for engaging a container, a sterile chamber formed on said rotor, and into which extend container mouths of containers that are to be closed, each container hanging from and being retained by a corresponding container carrier, said sterile chamber being delimited from surroundings thereof by walls or wall sections, a plurality of closing stations formed on a circumference of said rotor, each of said closing stations comprising a bellows that extends by a variable amount into said sterile chamber, said bellows defining an interior volume that remains outside said sterile chamber, a closing tool disposed in said interior volume of said bellows, said closing tool being constructed to apply a closure to a container by welding or sealing, wherein welding or sealing includes application of heat, said closing tool having functional elements, which are arranged outside said sterile chamber, and a part that cooperates with a structure selected from the group consisting of said container and a closure, said closing tool comprising a conductive structure selected from the group consisting of a passive component and a shaped part, wherein only said bellows extends into said sterile chamber during operation of said closing tool, and a device arranged outside said sterile chamber for producing energy for welding or sealing.

2. The apparatus of claim 1, wherein each of said closing tools comprises a lifting device for lifting and lowering the closing tool, said lifting device being arranged outside the sterile chamber.

3. The apparatus of claim 1, wherein each of the closing tools comprises a screw-capper, wherein said screw-capper comprises at least one rotational drive arranged outside the sterile chamber.

4. The apparatus of claim 3, wherein said screw-capper comprises a screw-capper section that extends into said bellows, and a capping cone that cooperates with said closures, said capping cone being disposed on said screw-capper section and outside of said bellows, whereby said capping cone is inside said sterile chamber and said screw-capper section is outside said sterile chamber and separated therefrom by said bellows.

5. The apparatus of claim 4, wherein said at least one rotation drive is configured to cause said capping cone to rotate relative to said section of said screw capper that extends into said sterile chamber, whereby said one section of said screw capper, which is separated from said sterile chamber by said bellows, remains stationary relative to said capping cone as said capping cone, which is inside said sterile chamber, is driven to rotate by said at least one rotation drive.

6. The apparatus of claim 1, wherein each of said closing stations further comprises an upper wall section that delimits the sterile chamber, wherein said upper wall section defines an opening through which said bellows extends for the passage of the part of a closing tool that cooperates with the closures.

7. The apparatus of claim 1, wherein the conductive structure comprises a metallic material.

8. The apparatus of claim 1, wherein the device for producing energy comprises an induction heating device.

9. The apparatus of claim 1, wherein said closing tool disposed in said bellows comprises an induction welding head, said welding head being configured to extend into said sterile chamber during extension of said bellows but to be separated from said sterile chamber by said bellows.

10. The apparatus of claim 1, wherein said sterile chamber is configured to be flushed with sterile gas.

11. The apparatus of claim 1, wherein said closing tool disposed in said bellows comprises an ultrasonic closing tool.

12. The apparatus of claim 1, wherein said closing tool disposed in said bellows comprises a microwave closing tool.

* * * * *